United States Patent [19]

Edling et al.

[11] 3,971,328

[45] July 27, 1976

[54] EMERGENCY MOORING RELEASE

[75] Inventors: Porter R. Edling, Houston; Kenneth L. Yoast, Texarkana, both of Tex.; Glenn D. Wickline, deceased, late of Houston, Tex., by Mrs. Glenn D. Wickline, executrix

[73] Assignee: The Offshore Company, Houston, Tex.

[22] Filed: Sept. 21, 1973

[21] Appl. No.: 399,404

[52] U.S. Cl. ..... 114/221 R; 114/206 R; 114/230

[51] Int. Cl.[2] ..... B63B 21/50

[58] Field of Search ..... 114/221 R, 230, 213, 114/215, 217, 206 R, 235 R; 9/32; 30/180, 228; 83/586, 639

[56] References Cited

UNITED STATES PATENTS

| | | | |
|---|---|---|---|
| 2,711,583 | 6/1955 | Raby | 30/228 |
| 3,029,676 | 4/1962 | Rabinon | 83/639 X |
| 3,296,995 | 1/1967 | Van der Linde | 114/235 R |
| 3,509,942 | 5/1970 | Lindberg | 244/135 R X |
| 3,616,717 | 11/1971 | Jones | 114/221 A |
| 3,654,649 | 4/1972 | Richardson | 114/206 R |
| 3,693,915 | 9/1972 | Ulanovsky | 244/135 R |
| 3,799,097 | 3/1974 | Robertson | 114/206 R |

*Primary Examiner*—Trygve M. Blix
*Assistant Examiner*—Gregory W. O'Connor
*Attorney, Agent, or Firm*—Vinson, Elkins, Searls, Connally & Smith

[57] ABSTRACT

A system for emergency release of a ship from its mooring cables is disclosed wherein pressurized actuating fluid stored in accumulators may be selectively released to actuate fluid powered cutters to sever the mooring cables. In its preferred form the system includes fire inerting apparatus adapted to operate in conjunction with the cable cutters to provide a fire inert atmosphere and thereby eliminate the possibility of fire or explosion resulting from sparks generated during the cutting operation. The system is remote controlled and operates on a power source independent from the ship's normal power. This abstract is neither intended to define the invention of the application, which of course is measured by the claims, nor is it intended to be limiting as to the scope of the invention in any way.

11 Claims, 2 Drawing Figures

EMERGENCY MOORING RELEASE

This invention relates to apparatus for emergency release of a ship or other floating object from its mooring or anchor lines, and more particularly to a system for emergency release which operates on power independent from the ship's normal power.

Not infrequently, situations arise in which a ship moored or anchored at one point must, for the safety of the ship or its personnel, be released quickly from its mooring lines in order to move to a position of greater safety. Such a situation may arise due to fire and explosion occurring near the ship from which the ship must escape, or in some instances may occur where the ship itself is on fire or possesses some other dangerous condition and it is desired to remove the ship from proximity to other ships, dock facilities, etc. In offshore drilling operations, a well blowout can create conditions of extreme danger where the ship is surrounded by flammable or explosive oil or gas released from the well.

The release should be accomplishable without the use of the ship's power since the presence of a flammable environment may make it necessary to fully shut down the ship's power system, or power may be lost due to an explosion, etc. Conventional mooring release procedures such as winching in the anchors, or reversing the winches to run off the remainder of the anchor line, cannot meet the requirements of a system which operates very rapidly and which operates independently of the ship's normal power.

It is accordingly the primary object of the present invention to provide a system for emergency release of a ship from its moorings which may accomplish such release almost instantaneously without use of the ship's normal power.

Another object is to provide such a system which can be used with complete safety even if the ship is in a flammable or explosive environment.

A further object is to provide such a system which may be operated by remote control from a point on the ship distant from the mooring lines.

Another object is to provide a mooring release system which, once set up, will remain in a ready-to-use condition indefinitely with little or no maintenance.

A more specific object is to provide such a system wherein fluid stored under pressure is utilized as a power source for operating hydraulic cable cutters and wherein the release of the fluid to operate such cutters is controlled by solenoid valves which may be operated from a remote control panel utilizing power from an electrical storage battery.

Figure 1:
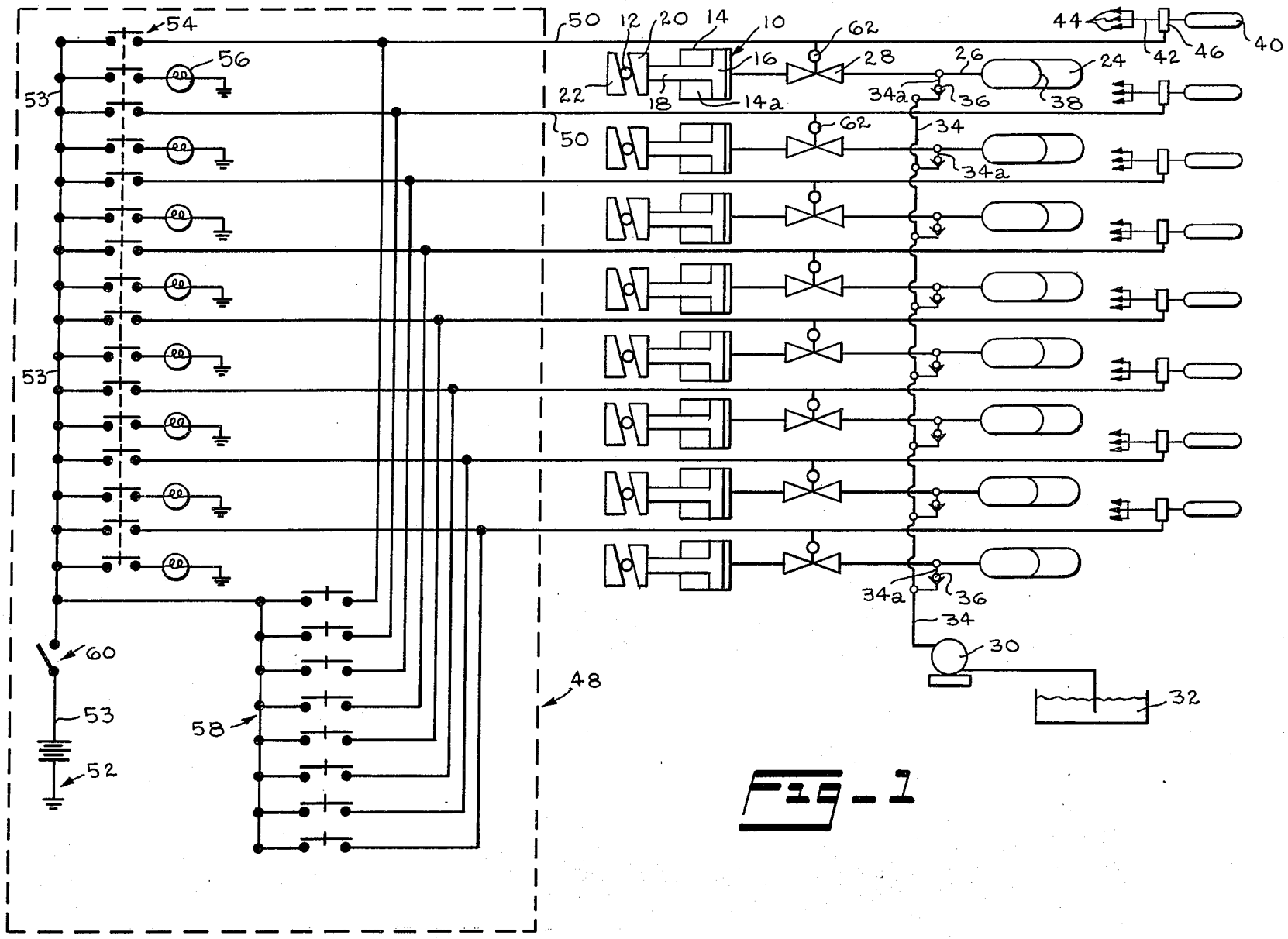
Figure 2:
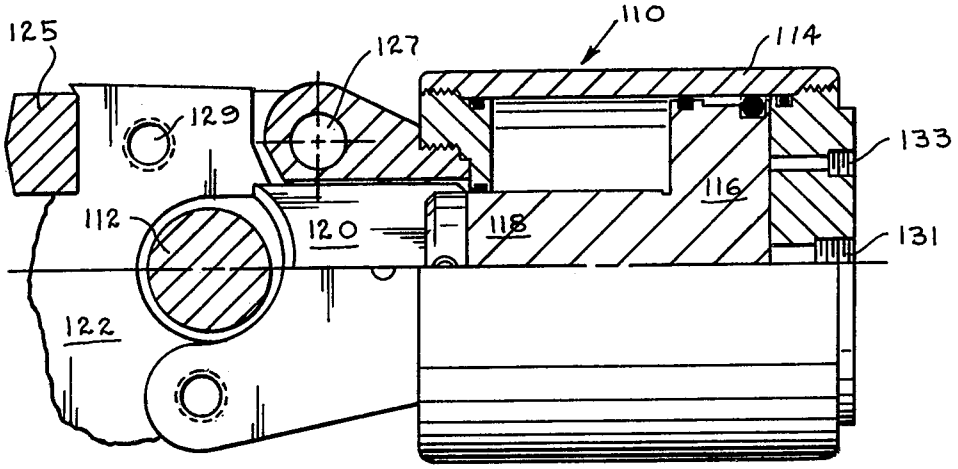

These and other objects and advantages of the invention will become apparent from the drawings, the specifications and claims. In the accompanying drawings, which illustrate the preferred embodiment of the invention, and wherein like numerals indicate like parts:

FIG. 1 is a combined schematic and one line drawing illustrating the preferred embodiment of the invention; and FIG. 2 is a view in elevation, and partly in section, of the preferred form of fluid powered cable cutter utilized in the system of the present invention.

Referring now to FIG. 1, there is shown the preferred form of the emergency mooring release system, that portion of the drawing within the dotted lines illustrating schematically the control panel from which the system is operated, and the remainder of the drawing illustrating diagrammatically the apparatus of the system. A plurality of fluid powered cable cutters 10 are provided, each cutter 10 being disposed in operative relationship to a mooring line or cable 12 by which the ship is moored. Cable 12, which is illustrated as being a wire rope, may of course, be a chain or other form of mooring line. While eight cutters are illustrated, a greater or lesser number may be utilized depending upon the number of mooring lines for which emergency release means are desired.

Each of the cutters 10 includes a fluid cylinder 14 having a bore **14*a* with a piston 16 slidable in the bore. A piston stem 18 extends forward from the piston through the end wall of the cylinder and mounts a blade 20 adapted upon actuation of the cutter to sever the cable 12. An anvil 22 is utilized in conjunction with the cutter to provide support for the cable 12 as it is being cut by the blade 20**.

The cutter is actuated by the admission of pressurized fluid into the bore **14*a* of the cylinder behind the piston 16, the fluid acting to move the piston 16 forward, along with piston stem 18 and cutter 20 until the cable 12 confined between the cutter blade 20 and anvil 22** has been severed.

Accumulator means are provided for storing the actuating fluid for cutters 10 under pressure. The accumulator means preferably comprise a plurality of hydraulic accumulators 24, with one accumulator being provided for each cutter 10. However, if preferred, a single accumulator may supply actuating fluid to several or all of the cutters used in the system. Fluid communication means, comprising fluid lines 26, are provided interconnecting each accumulator with its corresponding cutter 10. Valve means are provided in the fluid lines 26 for selectively blocking or permitting flow of actuating fluid from the accumulator to the cutter. Preferably a separate valve 28 is provided for each of the cutters 10. The valves 28 may be conventional solenoid valves adapted to open when supplied with electrical current to permit the flow of actuating fluid from the accumulator to the cutter. To provide valves which require a minimum of electrical power for operation, it may be desirable to use in valves 28 solenoid pilot valves which, when opened, release a supply of pressed gas to operate a valve operator to open the actual flow valve and release the actuating fluid to the cutters. Such pilot-over air-over liquid valves are well known to those skilled in the art and may be obtained as off the shelf items.

It is preferred that the actuating fluid be a liquid such as oil. The fluid may be supplied to the accumulators by a pump 30 drawing from a reservoir 32. Since the pump is used to charge the system under nonemergency conditions, it need not be powered independently from the ship and may be powered by the ship's normal electrical or compressed air system, or the like. A common flow line 34 extends from the pump outlet, with a branch line **34*a* connecting to the flow lines 26 of each of the accumulators 24. Check valves 36 are provided in each of the branch lines 34*a*** to prevent back flow.

Static pressure of the actuating fluid within the accumulators is provided by a gas, such as nitrogen, confined within a flexible envelope, or, as shown, behind an elastic diaphragm 38. As oil is pumped into the accumulator, the confined gas will be compressed and exert a pressure on the oil corresponding to the amount of compression.

During the cutting operation, friction generated between the blade 20 and cable 12, or the flailing of cable ends when the cable is cut under tension, could generate sparks which might ignite a fire or explosion. The preferred form of the system therefore includes fire inerting means disposed in operative relationship to the cutters and adapted to provide a fire inert environment during the actuation of the cutters. As shown in FIG. 1, the fire inerting means may comprise a plurality of storage bottles 40 containing a fire inerting fluid such as carbon dioxide or other fire preventing fluid or chemical. The bottles 40 are connected through flow lines 42 to a plurality of nozzles 44 which, in actual construction, would be disposed so as to spray the fire inerting gas throughout the area occupied by the cutter to prevent any sparks which may be generated from resulting in a fire.

Valves 46 are provided in the flow lines 42 for controlling release of the fire inerting gas. These are preferably solenoid valves which may be actuated by the same remote control means and power source as the valves 28 controlling actuation of the cutters.

Remote control means for selectively operating the valves controlling actuation of the cutters and of the fire inerting system comprise a control panel 48 located at any suitable point in the ship and connected to the valves by electrical lines 50. Communication systems other than electrical lines may be used to remotely actuate the cutters. For example, radio, acoustic, pneumatic or hydraulic communications could be used, but electrical lines are considered the preferred method. A power source is provided for the system independent of the ship's normal operating power. Preferably the power source is a chemical storage battery 52 which will provide sufficient power for operating the valves 28 and 46. On offshore drilling vessels a battery power pack is generally provided for emergency operation of the blowout preventer. Such a power pack might be used to power the mooring release system as well.

From the battery 52, a service line 53 extends to eight independently operable switches 54 which are provided for selectively closing or opening a circuit from the battery 52 to each of the wire lines 50 for supplying current to the valves 28 and 46 controlling the cutters and fire inerting apparatus. The switches 54 are preferably of the type which once closed remain closed until manually opened and may be double switches so as to simultaneously close a circuit to an indicator lamp 56 on the control panel indicating that the switch has been closed and the corresponding cutter actuated. An "all fire" switch 58 is also provided for actuating all of the cutters simultaneously. An arm switch 60 is provided in the service line 53 to lessen the possibility of accidental actuation of the cutters. So long as the arm switch 60 is in an open position no circuit can be completed.

In the preferred form of the invention, including the fire inerting system, it is desirable that the valves 46 controlling release of the fire inerting gas be opened a short time before the valves 28 controlling actuation of the cutters. This will assure that area surrounding the cutters will be fully flooded by the gas and a fire inert atmosphere provided before the cutters are actuated and any sparks are generated.

The desired sequence of operation may be accomplished by providing a timing switch 62 between the service lines 50 and actuating valves 28. Such switches, which are well known in the art, may be set to close, and complete the circuit to valves 28 a predetermined time, such as five or ten seconds, after current is supplied to the electrical line 50 by the closing of corresponding switch 54 in the control panel. Thus when a switch 54 is closed on the control panel 48, current will immediately be supplied, via line 50 to the corresponding valves 46 in the fire inerting system and fire inerting gas will be released from the storage bottle 40 through nozzles 44 to spray the area around corresponding cutter 10. A predetermined time later, the timing switch 62 will close and power will be supplied to the actuating valve 28 to open the valve and actuate the cutter.

Referring to FIG. 2 there is shown the preferred form of hydraulic cable cutter 110 for use in the system of the present invention. It includes a cylinder 114 with a piston 116 slidable in the bore thereof and having a piston stem 118 with the cutter blade 120 mounted thereon. The anvil 122 is pivotably connected to the cutter by lower pivot pin 123. The anvil 122 and blade 120 are configured so as to conform to the outer surface of the cable 112. A latch 125 mounted on the cutter by upper pivot pin 127 may be engaged, as shown in FIG. 2, when the cutter has been positioned about the cable so as to securely lock the anvil into position. A set screw may also be passed through corresponding openings 129 in the anvil and latch to prevent accidental disengagement of the latch.

Two ports are provided into the bore of the cylinder 114 behind the piston 116 with the larger or main bore 131 being intended for entry of actuating fluid into the cylinder and the smaller bore 133 serving as a bleed port to bleed fluid or air from the cylinder as the piston is retracted after having been actuated.

The system, once installed and charged may be maintained in ready condition indefinitely with very little maintenance. With valves 28 and 46 closed, the accumulators 24 are charged with fluid, preferably oil, from pump 30 through lines 34 and check valve 36. It has been determined from experimentation that approximately 3,000 pounds per square inch of pressure in the accumulators is adequate to operate cutters, such as those shown in FIG. 2, having an eight inch diameter cylinder bore and four inch stroke to sever three inch wire rope cables either slack or under tension.

The foregoing description and disclosure of the invention is illustrative and explanatory thereof, and various changes in the size, shape and materials, as well as in the details of the illustrated construction, may be made within the scope of the appended claims without departing from the spirit of the invention.

We claim:

1. A system for emergency release of a ship from its mooring cables comprising:

a plurality of fluid powered cable cutters, one cutter being prearranged in operable relationship to each cable for which emergency release may be desired and being adapted upon actuation to sever said cable;

charged accumulator means for storing under pressure actuating fluid for actuating said cable cutters;

fluid communication means interconnecting said cutters and said accumulator means;

valves means in said fluid communication means for selectively blocking or permitting flow of actuating fluid from said accumulator means to said cutters; and remote control means for selectively operating said valve means.

2. The system according to claim 1 wherein said remote control means are operated by a power source independent of the ship's normal power.

3. The system according to claim 2 wherein said power source is a chemical storage battery.

4. The system according to claim 1 wherein said cable cutters comprise:

a fluid cylinder;

a piston slidable in the bore of said cylinder;

a piston stem on said piston;

a blade on the end of said piston stem distant from said piston; and an anvil in fixed relationship to said cylinder;

said blade and anvil being adapted to receive between them the cable to be cut, whereby admission of pressurized actuating fluid into the bore of said cylinder behind said piston moves said piston forward to cause said blade to sever said cable.

5. The system according to claim 4 wherein said cutter and anvil are configured to conform to the outer surface of said cable.

6. The system according to claim 1 wherein said valve means comprise a separate valve for each cutter and wherein said control means includes valves which may be operated singly or in unison.

7. The system according to claim 1 wherein said accumulator means comprises a separate accumulator for each cutter.

8. A system for emergency release of a ship from its mooring cables comprising:

a plurality of fluid powered cable cutters, one cutter being prearranged in operable relationship to each cable for which emergency release may be desired and adapted upon actuation to sever said cable;

charged accumulator means for storing under pressure actuating fluid for actuating said cable cutters;

fluid communication means interconnecting said cutters and said accumulator means;

valve means in said fluid communication means for selectively blocking or permitting flow of actuating fluid from said accumulator means to said cutters;

remote control means for selectively operating said valve means; and fire inerting means disposed in operative relationship to said cable cutters and adapted to provide a fire inert environment during actuation of said cable cutters.

9. The system according to claim 8 wherein said fire inerting means are operated by the same remote control means used to operate said valve means to actuate said cutters.

10. A system for emergency release of a ship from its mooring cables comprising:

a plurality of fluid powered cable cutters, one cutter being prearranged in operable relationship to each cable for which emergency release may be desired and adapted upon actuation to sever said cable;

charged accumulator means for storing under pressure actuating fluid for actuating said cable cutters;

fluid communication means interconnecting said cutters and said accumulator means;

valve means in said fluid communication means for selectively blocking or permitting flow of actuating fluid from said accumulator means to said cutters;

remote control means for selectively operating said valve means;

fire inerting means disposed in operative relationship to said cable cutters and adapted to provide a firm inert environment during actuation of said cable cutters, said fire inerting means being operated by the same remote control means used to operate said valve means to actuate said cutters; and timing means associated with said valve means for delaying operation of said valve means until a preselected time after said fire inerting means are activated.

11. A system for emergency release of a ship from its mooring cables comprising:

a plurality of fluid powered cable cutters, one cutter being prearranged in operable relationship to each cable for which emergency release may be desired and adapted upon actuation to sever said cable;

charged accumulator means for storing under pressure actuating fluid for actuating said cable cutters;

fluid communication means interconnecting said cutters and said accumulator;

valve means in said fluid communication means for selectively blocking or permitting flow of actuating fluid from said accumulator means to said cutter;

remote control means for selectively operating said valve means;

fire inerting means disposed in operative relationship to said cable cutters and adapted to provide a fire inert environment during actuation of said cable cutters, said fire inerting means comprising:

a plurality of bottles of fire inerting fluid, one bottle being provided for each of said cable cutters;

at least one nozzle associated with each said bottle and disposed to spray fire inerting fluid about the correpsonding cable cutter;

conduit means interconnecting each of said bottles with the corresponding nozzle; and conduit valve means in said conduits for selectively permitting the flow of the fire inerting fluid from said bottles to said nozzles.

* * * * *